United States Patent [19]

Homer

[11] 4,386,264

[45] May 31, 1983

[54] TILL GUARDS

[76] Inventor: William G. Homer, 1 Wollaton Vale, Nottingham, England

[21] Appl. No.: 134,339

[22] Filed: Mar. 26, 1980

[30] Foreign Application Priority Data

Mar. 26, 1979 [GB] United Kingdom ..... 7910455

[51] Int. Cl.[3] ..... G07G 1/00

[52] U.S. Cl. ..... 235/1 R; 235/7 R

[58] Field of Search ..... 235/1 D, 7 R, 7 A, 22, 235/28, 1 R, 6, 1 E; 109/10, 19, 49.5; 312/137, 140.4

[56] References Cited

U.S. PATENT DOCUMENTS 1,568,356 1/1926 Vumbaca ..... 109/10

2,247,020 6/1941 Hilckman ..... 312/140.4

*Primary Examiner*—L. T. Hix

*Assistant Examiner*—Benjamin R. Fuller

*Attorney, Agent, or Firm*—Harding, Earley, Follmer & Frailey

[57] ABSTRACT

A guard for deterring thefts from open cash tills. The guard includes a pair of side barriers each of which, in use, projects from the till body in the direction of opening movement of the drawer so as to prevent direct side access to at least the rear of the drawer when in its fully open position and a top barrier extending between the side barriers so as to extend across and directly above at least the rear of the drawer when in its fully open position.

10 Claims, 5 Drawing Figures

TILL GUARDS

The present invention relates to a guard for a cash till.

Cash tills in common use today have a till drawer slidably received in the body of the till and after registering a cash sale the drawer is extended to enable access to the drawer contents. Unfortunately, when the till drawer is open it is vunerable to a thief snatching money from the till.

Snatch thefts from tills are on the increase, particularly in large department stores and supermarkets where large amounts of money are carried in the till.

In order to overcome this problem it is known to house the cashier and cash till in a kiosk and thereby isolate the cash till from a potential snatch thief, i.e. a paying customer.

Although a kiosk provides a solution to the problem of deterring snatch thieves it has the disadvantage of also isolating the cashier from the customer. This is particularly undesirable in department stores and supermarkets where the cashier needs to handle the goods. Additionally, provision of a kiosk for each cash till is undesirable in shops containing large quantities of cash tills since they take up a large area of valuable floor space and are expensive to install. Additionally since kiosks are large items they cannot be easily moved between different locations within the store. Again this is undesirable in a large department store where floor plans are often changed.

It is therefore a general object of the present invention to provide a guard which acts as a deterrent to a till snatch thief and which does not possess the drawbacks associated with a kiosk as mentioned above.

In accordance with the present invention there is provided a guard for use with a cash till having a drawer slidably housed in the body of the till and which in its fully open position extends from the body of the till to permit access to the rear of the drawer, the guard including a pair of side barriers each of which, in use, project from the till body in the direction of opening movement of the drawer to prevent direct side access to at least the rear of the drawer when in its fully open position and a top barrier between the side barriers so as to extend across and directly above at least the rear of the drawer when in its fully open position.

The guard of the present invention therefore prevents a thief from gaining direct access to the rear of the drawer either from above or from the side of the drawer and therefore makes it difficult and consequently deters him from snatching money from the rear of the drawer.

Figure 1:
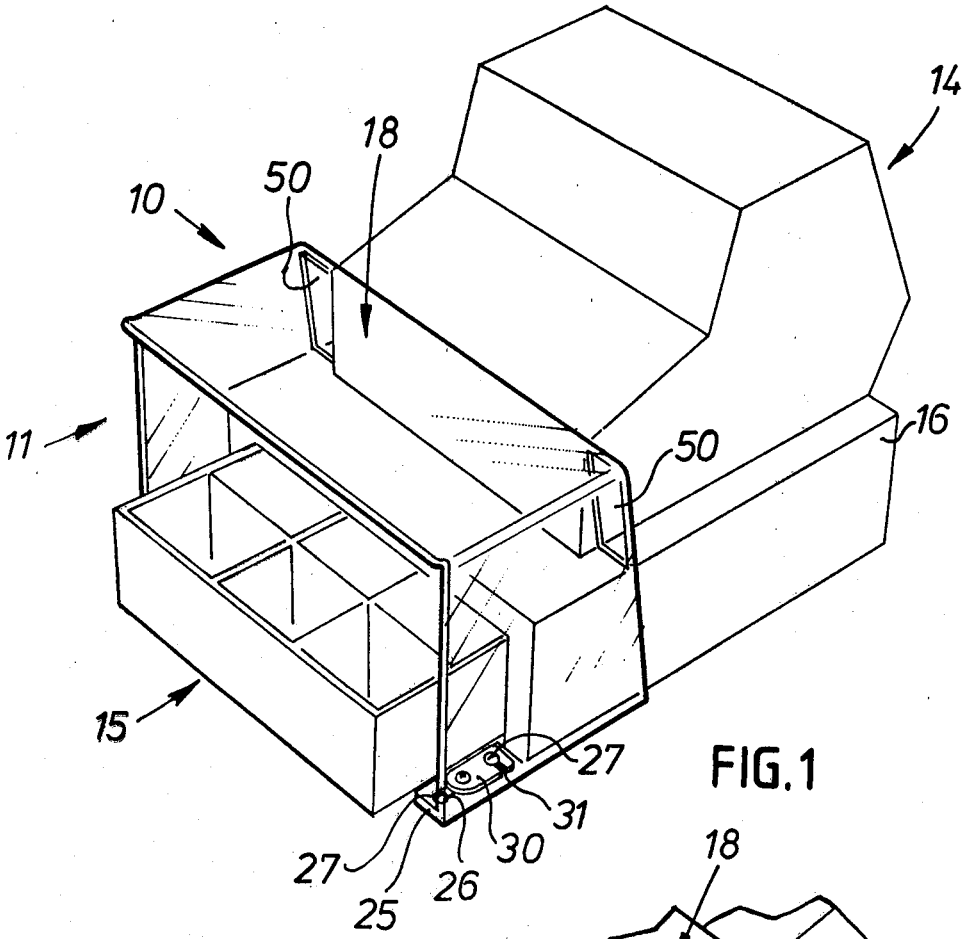
Figure 5:
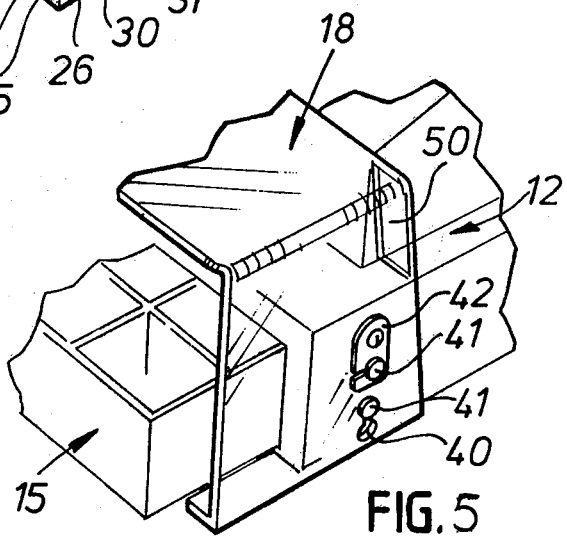
Figure 2:
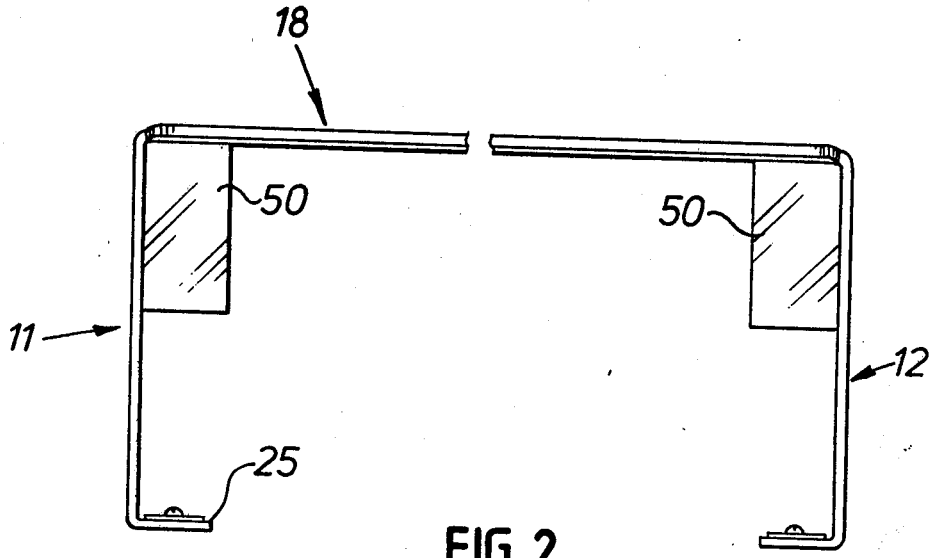
Figure 4:
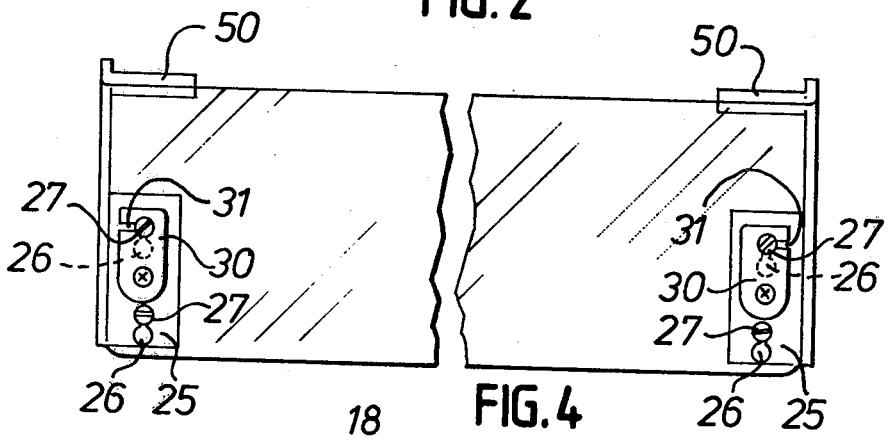
Figure 3:
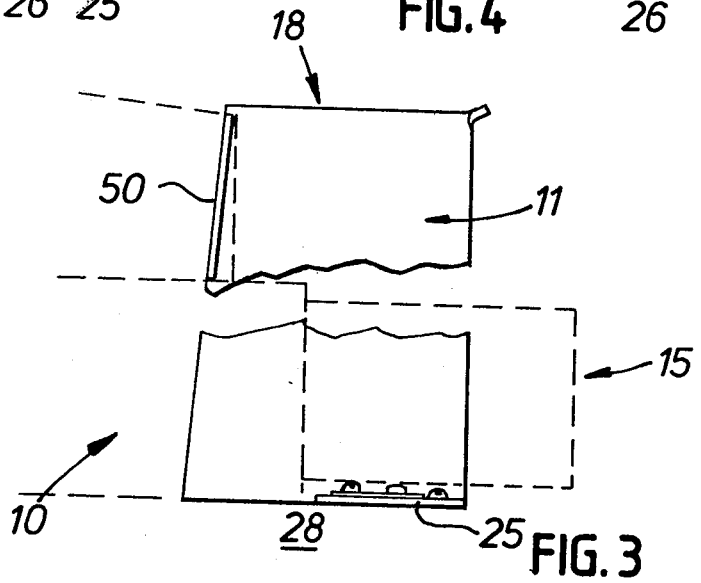

Reference is now made to the accompanying drawings, in which,

FIG. 1 is a schematic perspective view of a first embodiment according to the present invention illustrated in use with a cash till, FIG. 2 is a front view of the embodiment shown in FIG. 1, FIG. 3 is a side view of the embodiment shown in FIG. 1, FIG. 4 is a plan view of the embodiment shown in FIG. 1, FIG. 5 is a schematic perspective view of another embodiment according to the present invention.

The guard is generally shown at 10 and includes a pair of side barriers 11, 12 which are located either side of a cash till 14. The cash till 14 includes a drawer 15 which is slidably mounted in the body 16 of the till and is shown in FIGS. 1 and 3 in its fully opened position. Each side barrier 11, 12 is planar and lies in a plane substantially parallel to the direction of movement of the drawer 15 and as seen in FIGS. 1 and 3 each side barrier projects from the till body and is chosen to be of a width so as to prevent direct side access to the rear of the fully opened drawer. It will be appreciated that the width of each side barrier may be increased to prevent direct side access to a greater proportion or all of the drawer. Also, each side barrier need not necessarily be planar as shown. For instance each side barrier may be curved so as to extend upwardly and inwardly toward one another.

A top barrier 18 extends from one side barrier to the other so as to extend across and directly above the rear of the fully opened drawer. The top barrier 18 shown is planar but it will be appreciated that if desired it may be differently shaped. For instance it may be longitudinally curved so as to give a domed appearance.

The purpose of the top and side barriers is to prevent a person's hand passing therethrough to gain direct access from either side or from above into the opened drawer and accordingly the construction of each barrier is such as to achieve that purpose. For instance, each barrier may be composed of a frame-work of bars or each may be a solid wall of a suitable material such as wood, plastics or metal.

It is preferred that the top barrier be transparent so that the cashier may see into the whole of the drawer. Thus if the top barrier is a solid wall it is preferably constructed from a transparent material such as glass or a plastics material such as perspex (registered Trade Mark).

In the illustrated embodiment the guard stands on the lower edge of each side barrier and in order to anchor the guard in position each side barrier is provided with an inwardly directed flange 25 in which a pair of key-hole slots 26 are provided. In use screws 27 tapped into the support surface 28 on which the cash till stands project through the key-hole slots in order to anchor the guard 10 to the support surface. Each flange 25 is also provided with a latch member 30 which is pivotally secured at one end to its associated flange 25 and which is also provided with an open ended slot 31. The latch member 30 is arranged so that it may be swung about its pivot so that the open ended slot 31 embraces the shank of one of the screws projecting through one of the key-hole slots and thus restrains sliding movement of the guard relative to the support surface.

In the illustrated embodiment, the top and side barriers and inwardly directed flanges 25 are formed integrally from perspex although other transparent plastics materials may be used if desired. A pair of reinforcing members 50 are glued in position between each side barrier and top barrier in order to provide added strength and also to close openings between the rear of the guard and the cash till. Accordingly, the rear open side of the guard has a profile which is approximately shaped to the peripheral contour of the front of the cash till.

It is envisaged that the till guard could be adapted for attachment directly to the cash till, for example as schematically illustrated in FIG. 5. In the embodiment shown in FIG. 5, key hole slots 40 are formed in each side barrier and they receive studs 41 projecting from the body of the till. A latch member 42 similar to latch member 25 is pivotally mounted on each side barrier so as to be able to embrace a stud projecting through one of the key hole slots to thereby lock the guard in position.

It is also envisaged that the top barrier may be constructed so as to be adjustable in length so that the distance between the side barriers may be adjusted to accommodate for differing widths of cash tills.

What is claimed is:

1. A guard for use with a cash till having a drawer slidably housed in the till body and which in its fully open position extends from the till body to permit access to the rear of the drawer, the guard including a pair of side barriers each of which, in use projects from the till body in the direction of opening movement of the drawer so as to prevent direct side access to at least the rear of the drawer when in its fully open position and a top barrier extending between the side barriers so as to extend across and directly above at least the rear of the drawer when in its fully open position.

2. A guard as claimed in claim 1 wherein each side barrier is substantially planar and lies in a plane substantially parallel to the direction of opening movement of the drawer.

3. A guard as claimed in claim 2 wherein the side barriers include anchorage means for anchoring the guard to a cash till.

4. A guard as claimed in claim 2 wherein the side barriers include anchorage means for anchoring the guard to a support surface on which the cash till stands.

5. A guard for use with a cash till having a drawer slidably housed in the till body and which in its fully open position extends from the till body to permit access to the rear of the drawer, the guard including a pair of substantially planar side barriers each of which, in use, stands on a support surface and projects from the till body in the direction of opening movement of the drawer so as to prevent direct access to at least the rear of the drawer when in its fully open position, a top barrier extending between the side barriers so as to extend across and directly above at least the rear of the drawer when in its fully open position and anchorage means for anchoring the guard to the support surface.

6. A guard as claimed in claim 5 wherein the pair of side barriers and top barrier are integrally formed from a rigid plastics material.

7. A guard as claimed in claim 6 wherein the anchoring means for each side barrier comprises an inwardly directed flange having key-hole slots for receiving anchoring studs projecting from the support surface and latch means for engaging the studs to restrain sliding movement between the side barriers and support surface.

8. A guard as claimed in claim 7 wherein the inwardly directed flanges are formed integrally with its associated side barrier.

9. A guard as claimed in claim 1 wherein the top barrier is adjustable in length so as to enable adjustment of the distance between the side barriers.

10. A cash till including a drawer slidably housed in the till body and which in its fully open position extends from the till body to permit access to the rear of the drawer, a guard having a pair of side barriers each of which projects from the till body in the direction of opening movement of the drawer so as to prevent direct side access to at least the rear of the drawer when in its fully open position, and a top barrier extending between the side barriers so as to extend across and directly above at least the rear of the drawer when in its fully open position.

* * * * *